US005388435A

United States Patent [19]

Bailey

[11] Patent Number: 5,388,435

[45] Date of Patent: Feb. 14, 1995

[54] LOCK

[75] Inventor: Ronald F. Bailey, Omaha, Nebr.

[73] Assignee: Verdure Industries, Inc., Omaha, Nebr.

[21] Appl. No.: 263

[22] Filed: Jan. 4, 1993

[51] Int. Cl.[6] ..... E05B 65/06

[52] U.S. Cl. ..... 70/101; 70/202; 70/211; 70/339; 70/427; 292/100

[58] Field of Search ..... 70/57, 6–12, 70/101, 120, 232, 256, 201, 202, 209–211, 215, 277, 279, 416, 337, 339, 343, 455, 423, 424, 427, 428; 292/100, 240

[56] References Cited

U.S. PATENT DOCUMENTS

| | | | |
|---|---|---|---|
| 139,430 | 5/1873 | Smith | 70/12 |
| 620,397 | 2/1899 | Wright | 70/423 |
| 993,067 | 5/1911 | Hood . | |
| 2,166,660 | 7/1939 | Handshy et al. | 70/9 |
| 2,373,783 | 4/1945 | Schlifer | 70/101 |
| 3,263,462 | 8/1966 | Suroff et al. | 70/416 |
| 3,725,939 | 4/1973 | Saltzstein | 343/225 |
| 3,893,722 | 7/1975 | Galbreath et al. | 70/211 X |
| 4,118,962 | 10/1978 | Block et al. | 70/423 X |
| 4,135,377 | 1/1979 | Kleefeldt et al. | 70/279 X |
| 4,142,390 | 3/1979 | Schroeder | 70/371 |
| 4,640,109 | 2/1987 | Schaublin et al. | 70/371 X |
| 4,656,852 | 4/1987 | Deschamps | 70/339 |
| 4,761,975 | 8/1988 | Kachnowski et al. | 70/232 |
| 4,898,008 | 2/1990 | Eberly | 70/56 |
| 5,154,458 | 10/1992 | Cook et al. | 70/417 X |
| 5,168,258 | 12/1992 | Radke | 70/54 X |

FOREIGN PATENT DOCUMENTS

| | | | |
|---|---|---|---|
| 29182 | 11/1916 | Norway . | |
| 608267 | 12/1978 | Switzerland | 70/427 |

*Primary Examiner*—Peter M. Cuomo
*Assistant Examiner*—Suzanne L. Dino
*Attorney, Agent, or Firm*—Vincent L. Carney

[57] ABSTRACT

To prevent the unauthorized unlocking of van doors equipped with safety rod locks, the lever of the safety rod lock is held to the door by a retainer clip. The retainer clip has an extending tongue with apertures in it that passes through the door into the van. In the van, there is a dead bolt which may be actuated by a key cylinder inserted from outside the van through the door to cause the dead bolt to enter an aperture and lock the extending tongue of the retainer and hold the retainer in place so that the lever cannot be moved to unlock the safety rod lock. A second key actuated member or solenoid actuated member is actuated to move a cam in front of the first key slot so that it cannot be unlocked until the second cam lever is moved out of the way. Thus, a sequence must be followed using two different actuating means to unlock the door or lock the door.

4 Claims, 8 Drawing Sheets

LOCK

BACKGROUND OF THE INVENTION

This invention relates to methods and apparatuses for locking and unlocking doors, such as for example, van doors equipped with safety rod locks.

In one class of safety rod locks for vans, each door has an upper keeper mounted to the van frame above the door and has a lower keeper mounted to the van frame below the door along a vertical line with the upper keeper. The upper and lower keepers are adapted to mate with the vertical rods, which serve as lock bolts. There is an outside lock portion for moving the rods and keepers with respect to each other. The lock bolt or rod is positioned against the outside surface of the door near its edge to hold the door from opening when the ends of the bolt are held by the keepers. A lever moves the rod to free it from or to engage it with the keepers.

In a prior art type of lock in this class, the lever is fastened by a padlock on the outside of the van to be locked and unlocked by a key. In another prior art type of lock in this class, the cam rods are held together by two steel matching loops locked by a padlock in their center. In all of these cases the lock is accessible from outside the van and can be removed.

This type of prior art lock has a disadvantage in that the lock itself is readily available to persons who wish to remove it. Even padlocks that have protective shielding such as metal can be reached and opened.

SUMMARY OF THE INVENTION

Accordingly, it is an object of the invention to provide a novel apparatus and method for locking doors.

It is a further object of the invention to provide a novel safety rod lock for vans.

It is a further object of the invention to provide a novel van lock which is difficult to unlock except by persons who are authorized.

It is a still further object of the invention to provide a lock which is partly on the outside of the door and partly on the inside of the door.

In accordance with the above and further objects of the invention, a lock includes first and second locking means. The first locking means is actuated to cause a rod or lock bolt to be engaged within a keeper and the second locking means blocks access to the first locking means so that, to remove the bolt from the keeper and unlock the door, the second locking means must first be actuated to unprotect the first locking means and then the first locking means actuated to remove the bolt from the keeper.

The first and second locking means may be actuated from outside the door and generally the bolt and keepers are outside the door. However, the mechanism for blocking the first locking means is inside the door such as being within a van and the first locking means is at least partly inside the door. The mechanism outside the door may include two key-operated locks or a key-operated lock and an electrically-operated lock such as a lock operated by radio control or by an electrical connection or the like. This provides added security by preventing access to the mechanism for protecting the first locking means from outside the door and by requiring two distinctive operations before the door can be unlocked.

In the preferred embodiment, the doors that are locked may be doors of a van which swing open from the center. There is a separate lock on each door of the safety rod type or cam rod type. In this type of lock, the lock bolt or cam rod extends vertically from a keeper on top of the door to a keeper below the door and is adapted to be engaged in the keepers which are mounted to the frame of the truck to firmly hold the door closed at multiple points across the length from top to bottom.

To engage the ends of the rod in the keepers, a lever is attached to the rod to rotate the rod into a position where it engages the keepers, preferably with a camming action that tightly seals the door. When the rod is rotated into the locking position in which it engages its two keepers, the lever fits within the lock and a lever retainer passes through the door with its outside end being bent over the lever to hold it in place. The inside end of the retainer is adapted to receive a dead bolt within the van actuated by the first locking means from outside the door. The second locking means protects the first locking means so it cannot be unlocked unless the second locking means is deactuated.

The first and second locking means may be key-operated locks with the first key actuated lock being able to move the dead bolt into a hole in the lever retainer or permit it to be removed from the lever retainer and the second key-operated lock being able to move a lever that blocks the use of the first locking means when actuated. The lever retainer may include another extending armature positioned to overlie the lever when the lever retainer is in position and thus protect it from being cut.

In the above description, it can be understood that the lock of this invention has several advantages, such as for example: (1) it includes protective elements that are difficult to reach and difficult-to open from outside the van by unauthorized persons; (2) many of the moving mechanisms such as the dead bolt and the like are inside the protected compartment where they are not exposed to the elements; (3) it may be adapted for automatic radio control or combined radio control and key control; and (4) it is easily adapted for requiring two different people to participate in opening the door, each with a separate key for security reasons if desired.

SUMMARY OF THE DRAWINGS

The above noted and other objects of the invention will be better understood from the following detailed description when considered with reference to the accompanying drawings, in which.

DETAILED DESCRIPTION

Figure 1:
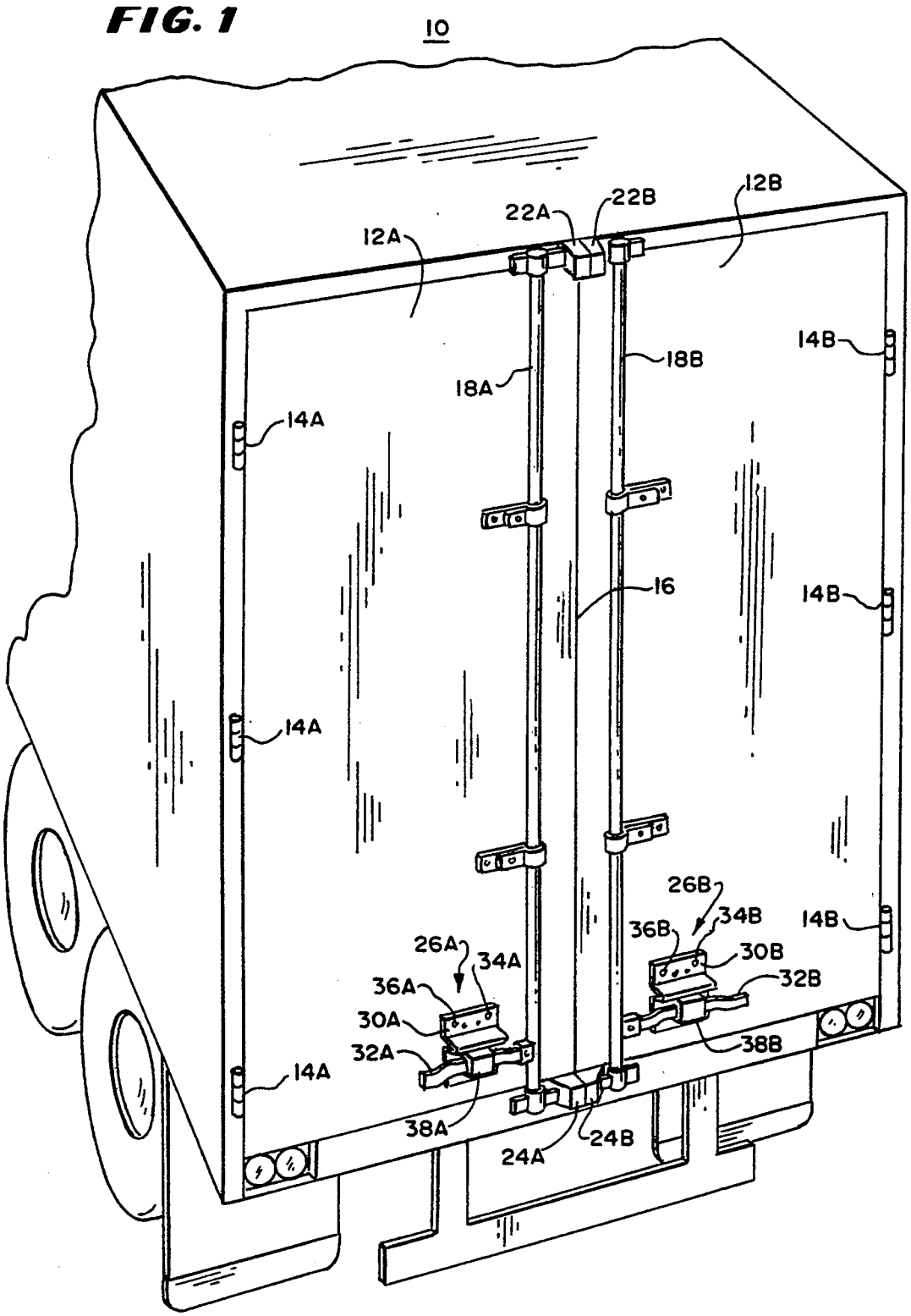
FIG. 1 is a fragmentary perspective view of a van equipped in accordance with the invention.

In FIG. 1, there is shown a fragmentary perspective view of a van 10 incorporating first and second doors 12A and 12B hinged at the sides of the doors at 14A and 14B and meeting at line 16 near which are first and second safety rod locks in accordance with an embodiment of the invention. Each of the two safety rod locks is mounted in juxtaposition with a corresponding one of the doors 12A and 12B and includes corresponding ones of upper keepers 22A and 22B, lower keepers 24A and 24B, rods 18A and 18B and locks 26A and 26B.

The safety rod locking mechanism for each door is identical to the safety rod locking mechanism of the other door and only one will be described hereinafter, the other one being mounted to the adjacent door but operating in the same manner. The safety rod locking mechanism mounted to door 12B includes an upper keeper 22B mounted above the door to the frame of the van 10 and the lower keeper 24B mounted below the door to the frame of the van 10, each keeper being positioned to receive a corresponding upper and lower end of the rod 18B, which may be a steel tube or steel rod of sufficient diameter and length to hold the door 12B from opening.

The rod 18B is mounted and supported in sleeves mounted to the door 12B for further support and adapted to move with the door as the door moves inwardly and outwardly. It is sufficiently strong to hold the door against shifting of a load within the van and is mounted at a location overlying the door 12B, and adjacent to the opening line 16.

The lock 26B includes a face plate 30B, a lever arm 32B, a first keyhole 34B for a first lock actuator, a second keyhole 36B for a second lock actuator, and a lever retainer 38B. These portions of the lock 26B are the front-of-the-door portion of the lock and other portions of the lock are mounted behind the closed door within the van 10 and will hereinafter be referred to as the behind-the-door section of the lock. The front-of-the-door and the behind-the-door sections cooperate together through openings in the door.

The face plate 30B is mounted by bolts to the door 12B and contains an opening in it adapted to receive a portion of the lever retainer 38B which holds the lever arm 32B when the door 12B is locked by the safety rod lock. One end of the lever arm 32B is mounted to the rod 18B and adapted so that when it is pulled away from the door 12B, the rod 18B rotates in a clockwise direction looking from the top of the door. In other embodiments, the lever arm .may incorporate different motions such as an upward and a downward motion to remove a safety lock door, but in this embodiment which is a cam-top door lock, rotation of the rod 18B into the position shown in FIG. 1 by the lever arm, cams the rod 18B against the door 12B to form a seal, and rotation in the other direction releases the ends of the rod 18B from the keepers 22B and 24B so that it and the door may swing open.

In this embodiment of the door lock, two locking means must be actuated in a predetermined sequence to lock and unlock the door and the major portion of the mechanism of the lock is mounted in the behind-the-door section where it is protected against weathering and unauthorized persons who otherwise would unlock the door. The two actuating mechanisms are used to open the door from the outside, but they are separately controlled and may even be in the possession of different persons to provide adequate control over the opening of the door.

The rod 18B, the keepers 22B and 24B and the lever arm 32B may be any of many commercial type rods and levers, such as model number 7528/7529 adjustable cam-type door lock sold by Eberhard Corporation or model number 5652 two-point cam-type door lock sold by the same company and available at Eberhard Hardware Mfg. Ltd., 21942 Drake Rd., Cleveland, Ohio 44136. Another suitable unit is that sold by Austin as model number 311-A or number 311-B heavy-duty safety rod lock and available from Austin Hardware and Supply of Dallas Inc., 3410 Enterprise Drive, Rowlett, Tex. 75088.

Figure 2:
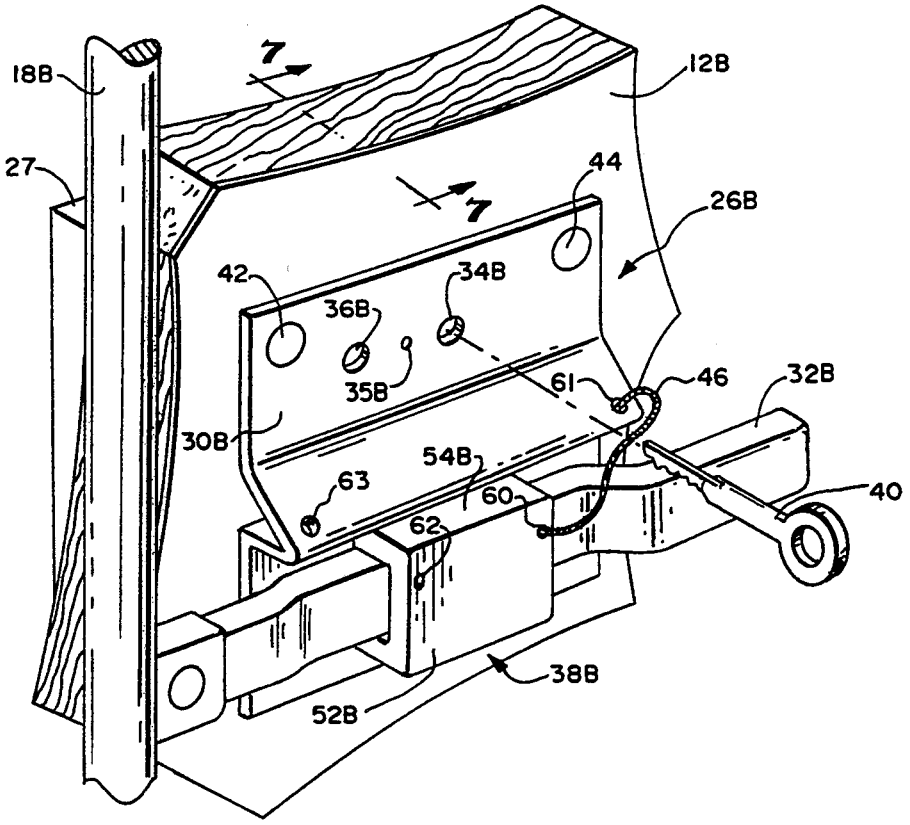
FIG. 2 is a fragmentary perspective view of a safety rod lock mounted to the door of a van in accordance with an embodiment of the invention.

In FIG. 2, there is shown a fragmentary perspective view of the lock 26B having a behind-the-door section 27, and a front-of-the-door section including the face plate 30B, the keyholes 34B and 36B, the lever 32B, the lever retainer 38B and the rod 18B mounted on or in juxtaposition with the door 12B and connected through the lever retainer 38B with the behind-the-door section 27. A key is shown exploded away at 40 to actuate the second locking means by engaging the keyhole at 34B. A similar key or the same key is used with keyhole 36B.

Mounting holes are shown at 42 and 44 to mount the face plate 30B to the door 12B and similar mounting holes are hidden by the lever arm 32B. A cable hole 60 in the retainer 38B may be used to fasten a cable 46, the other side being fastened through a hole 61 in the face plate 30B so that the lever retainer 38B, when the door is not blocked, is securely fastened for easy insertion. Similar holes are provided at 63 and 62 for attaching conventional door sealer elements.

Figure 3:
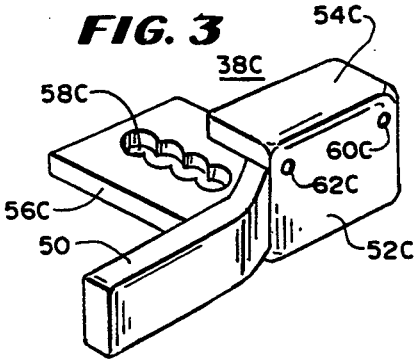
FIG. 3 is a perspective view of a lever lock retainer which forms a portion of the embodiments of FIGS. 1 and 2.

In FIG. 3, there is shown another embodiment of lever retainer 38C having a horizontal top right regular parallelopiped-shaped section 54C, a vertical right regular parallelopiped-shaped section 52C, a second horizontal right regular parallelopiped-shaped section 56C, and a vertical lever hinge guard 50. The embodiment 38C is shaped in the same manner as the embodiment 38B except the embodiment 38B does not have the lever hinge guard 50 which extends in the direction of the rod 18B (FIGS. 1 and 2) and is positioned to overlie the end of the lever arm 32B (FIGS. 1 and 2) that connects with the rod 18B to render it inaccessible for cutting.

The second horizontal section 56C is elongated to a greater extent than the first horizontal section 54C so as to pass through the door 12B (FIGS. 1 and 2) and contains vertical openings 58C which are adapted to receive a dead bolt so that the lever retainer 38C and the lever retainer 38B can be held from behind the door in position and hold the lever arm 32B.

To hold the lever arm 32B in the door locked position, the retainer 38C is shaped so that the vertical section 52C between the top and bottom 54C and 56C corresponds to the vertical dimension of the lever arm 32B, the top section 54C overlies the top of a portion of the lever arm 32B and abuts the face plate 30B (FIGS. 1 and 2) and the horizontal bottom portion 56C is under the lever arm 32B. However, the bottom section 56C extends through the door 12B into the behind-the-door section 27 so that it can be locked in place and firmly lock the lever arm 32B in place. The elongated vertical lever hinge guard 50, of course, protects the connecting section of the lever arm 32B in the embodiment of FIG. 4. The embodiment of FIG. 2 operates in the same manner but does not include the guard section 50.

Figure 4:
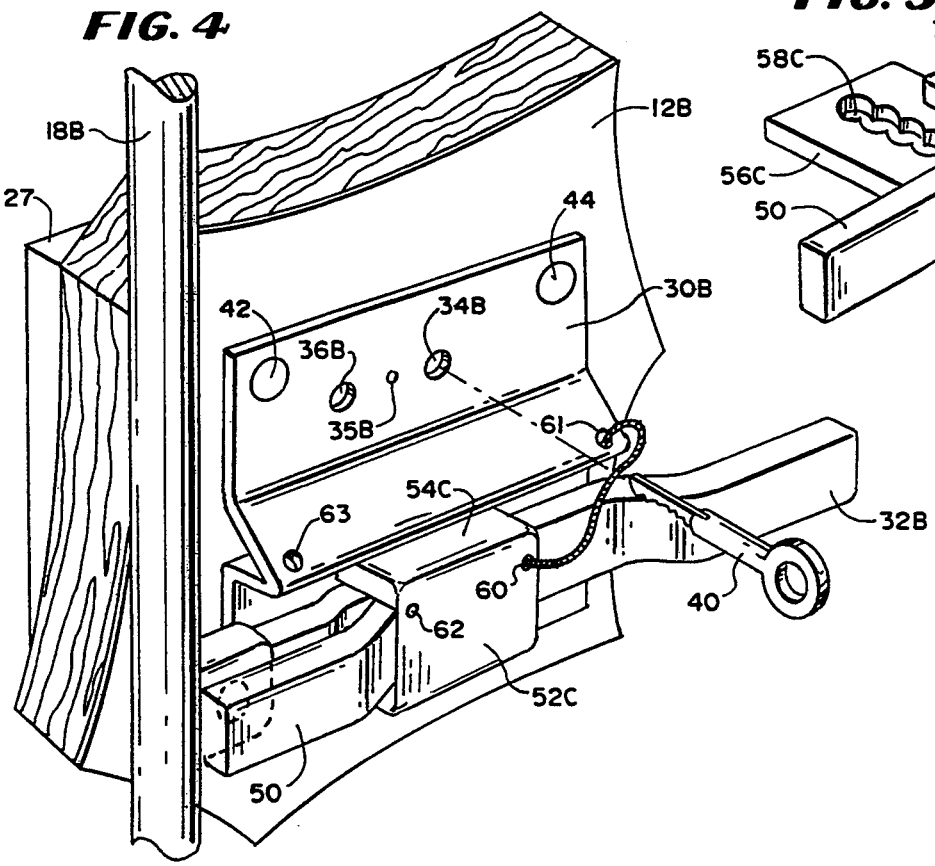
FIG. 4 is a fragmentary perspective view of another embodiment of safety rod lock connected to a door of a van, partly exploded to show a key used in accordance with the embodiments of FIGS. 1–3.

In FIG. 4, there is shown a lock incorporating the embodiment of retainer 38C but otherwise being identical to the lock 26B shown in FIG. 2. Similar parts are labeled with similar numbers and will not be further described. In the embodiment of FIG. 4, the lever hinge guard 50 is shown in position protecting the connecting end of the lever arm 32B that is connected to the rod 18B when the door is locked.

Figure 5:
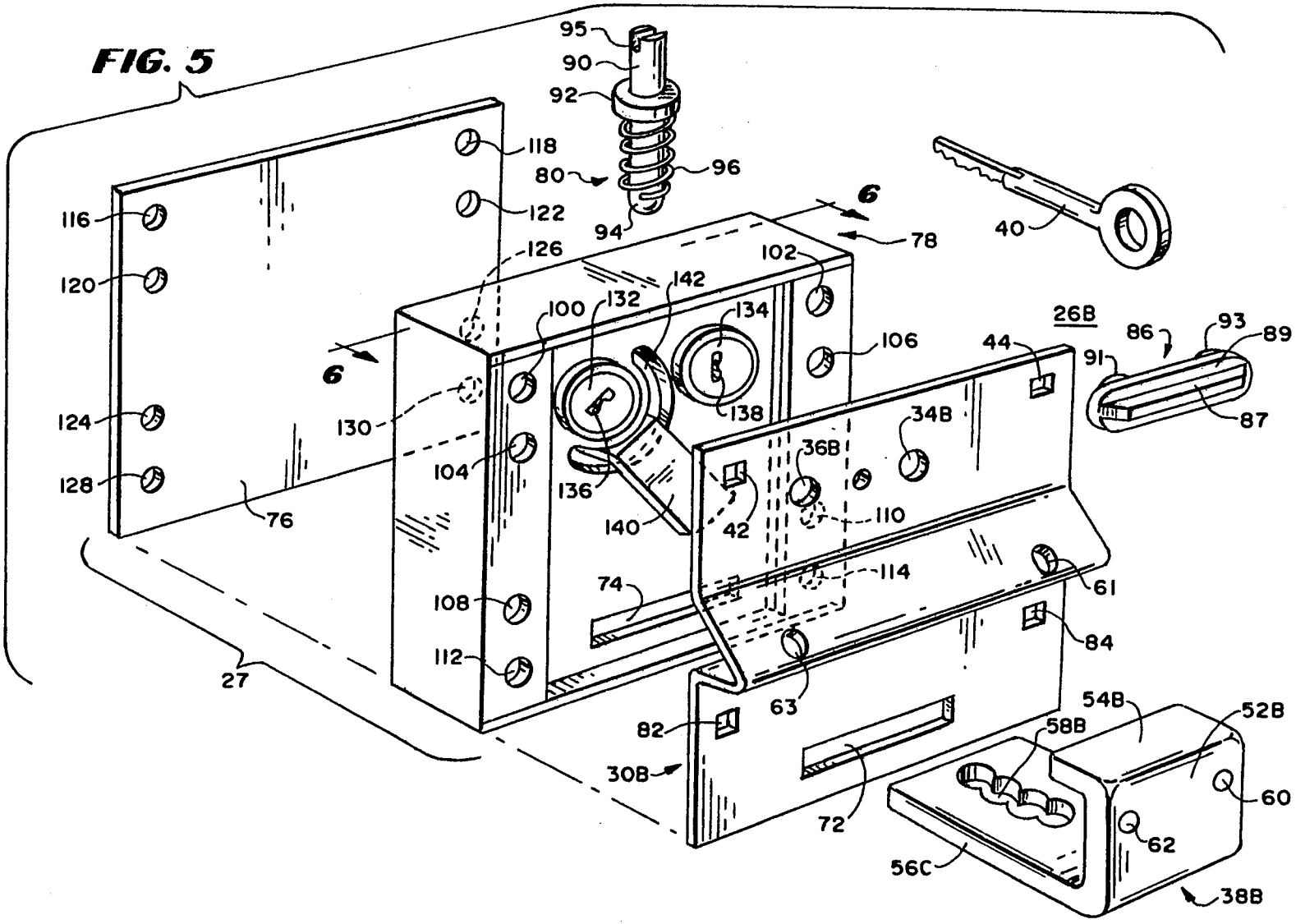
FIG. 5 is an exploded perspective view of a lock in accordance with an embodiment of the invention.

In FIG. 5, there is shown an exploded perspective view of the lock 26B having the retainer 38B, the face plate 30B, and the back-of-the-door section 27. As shown in this view, the front-of-the-door section is aligned on the front of the door 12B (FIGS. 1 and 2), with the back-of-the-door section 27 and for this purpose, the mounting bolt holes 42 and 44 and 82 and 84 on the face plate 30B are aligned with holes in the door (not shown in FIG. 5), with corresponding ones of bolt holes 100, 102, 108 and 110 in a cabinet 78 and with corresponding holes 116, 118, 124 and 126 in a back plate 76 for the cabinet 78, with the cabinet 78 holding the back-of-the-door section 27. Thus, the bolts passing through the bolt holes in the face plate 30B, front of the cabinet 78 and back plate 76 may mount the entire assembly to the door 12B in aligned position.

In this position, the keyholes 34B and 36B are aligned with keyslots 138 and 136 respectively in corresponding key cylinders 134 and 132 so that a key such as that shown exploded at 40 may be inserted through the keyholes and the keyslots in the key cylinders for actuating of the first and second locking means or actuating means to lock or unlock the door. Similarly, a rectangular slot 72 in the face plate 30B is aligned with a similar slot in the door 12B and a slot 74 in the front face of the cabinet 78 sized to receive the bottom 56B of the retainer 38B so that the vertical openings or holes 58B are behind the door within the cabinet 78 while the top 54B, front 52B and the portion of the bottom 56B adjacent to the front 52B hold the lever arm 32B (FIGS. 1, 2 and 4) in place.

To protect the cylinders 134 and 132, a plastic keyhole cover 86 includes a finger grip portion 87, a rectangular base 89 and first and second keyhole fillers 91 and 93. The fillers 91 and 93 have the same diameters as the key holes 34B and 36B in the face plate 30B and extend therein so as to protect the cylinders 134 and 132. The finger grip portion 87 may be grasped to pull the cover 86 off when it is desirable to actuate the first and second locking means from outside of the van.

In addition to the bolt holes 100, 102, 108 and 110, the slot 74 and key cylinders 134 and 132, the cabinet 78 includes assembly screw holes 104, 106, 112, and 114 as well as a semi-circular slotted opening 142, a lever arm 140 and a dead bolt 80 shown exploded away. The assembly screw holes 104, 106, 112, and 114 are located to align with similar openings 120, 122, 128 and 130 in the back plate 76 so as to close the cabinet 78.

The lever arm 140 is positioned to rotate within the opening 142 together with the cylinder 32 so that a key passed through the keyhole 36B into the slot 136 may be used to rotate the cylinder 32 and arm 140. The arm 140 extends a long enough distance to cover the keyslot 138 within the cylinder 134 and prevent the key from being entered therein. To permit rotation of the arm 140, the central portion of the front face of cabinet 78 is recessed a sufficient distance so that the cylinders 132 and 134 and the arm 140 are spaced from the door 12B (FIGS. 1, 2 and 4) to permit movement of the arm 140.

With this arrangement, the door may be locked by actuating the first locking means including the cylinder 134 with a key passing through the keyhole 34B and then this keyhole may be protected against tampering by an unauthorized person by inserting a key through the keyhole 36B and into the slot 136 to rotate the cylinder 132 and move the arm 140 over the keyslot 138. To unlock the door, the process must be reversed with the key first turning cylinder 132 to remove the arm 140 from the keyslot 138 before actuating the keyslot so as to remove the dead bolt 80 from its corresponding opening in the series of openings 58B of the retainer 38B. Once it is unlocked, however, the retainer may be pulled free to release the lever arm and permit turning of the rod 18B so as to free its ends from its corresponding keepers and permit the door to be opened.

The dead bolt 80 is within the cabinet 78 and includes a top portion 90, an expanded central annular flange 92 and a dead bolt stem 94. A return spring 96 is positioned around the dead bolt stem 94 to bias the dead bolt upwardly in a manner to be described hereinafter, and the dead bolt top portion 90 includes a slot 95 in the upper portion adapted to receive one embodiment of cam to push the dead bolt downwardly during a locking operation. The stem 94 has a diameter corresponding roughly to the diameter of a series of holes 58B in the retainer 38B so as to secure that retainer when it is pressed downwardly during actuation of the first locking means by turning of the cylinder 134.

Figure 6:
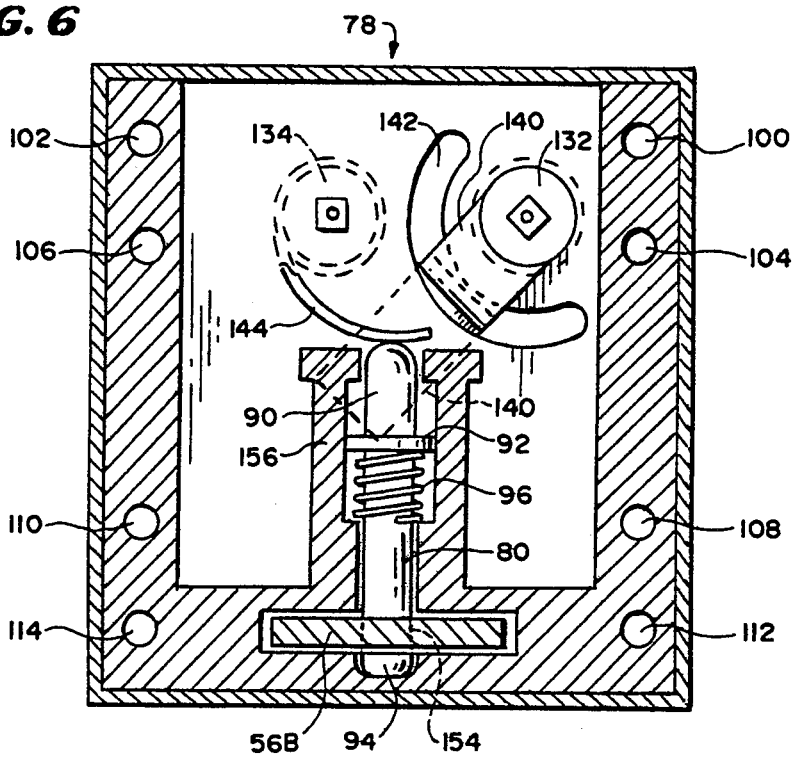
FIG. 6 is a sectional view taken through lines 6—6 of FIG. 5.

In FIG. 6, there is shown a sectional view taken through line 6—6 of FIG. 5 showing the dead bolt 80 depressed by a second cam arm 144 downwardly through an opening 154 in the bottom portion 56B of the lever retainer 38B with the shoulder 92 pressing the spring 96 against a shoulder in the dead bolt guide boss 156 to bias the dead bolt 80 upwardly against the second cam arm 144. The first cam arm 140 is shown downwardly within the .slot 142 and not yet moved into position to guard the cylinder 134 against change.

Figure 7:
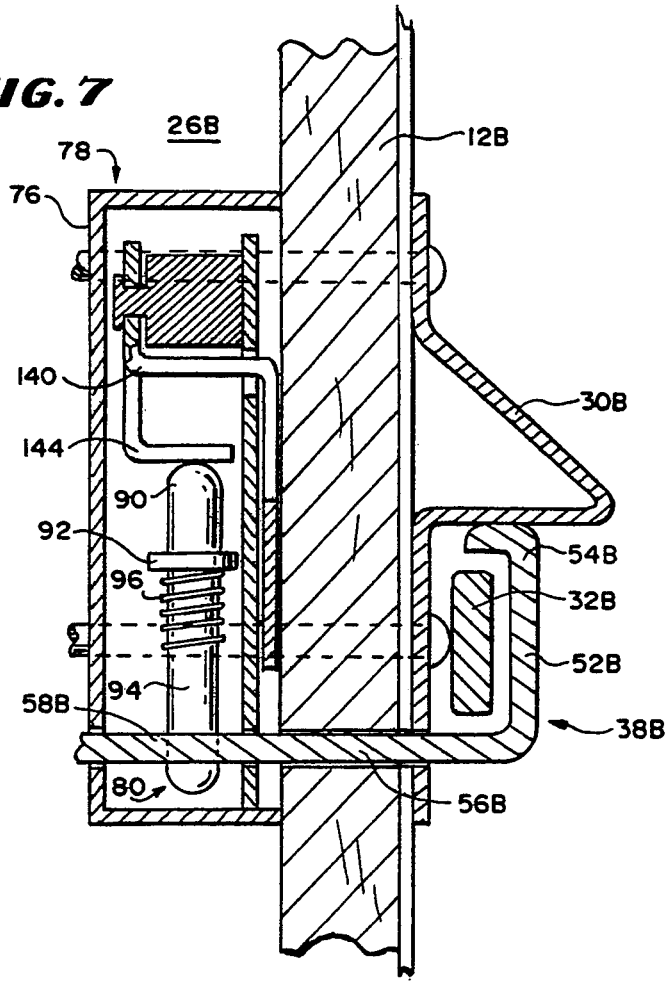
FIG. 7 is a sectional side view taken through lines 7—7 of FIG. 2.

In FIG. 7, there is shown a sectional side view of the lock 26B and the door 12B taken through lines 7–7 of FIG. 2 showing the dead bolt 80 passing through the openings 58B in the bottom 56B of the retainer 38B and thus locking the lever 32B in place against the door 12B.

With this arrangement, the door 12B is pressed closed and sealed by the rod 18B (FIG. 1) within the keepers.

Figure 8:
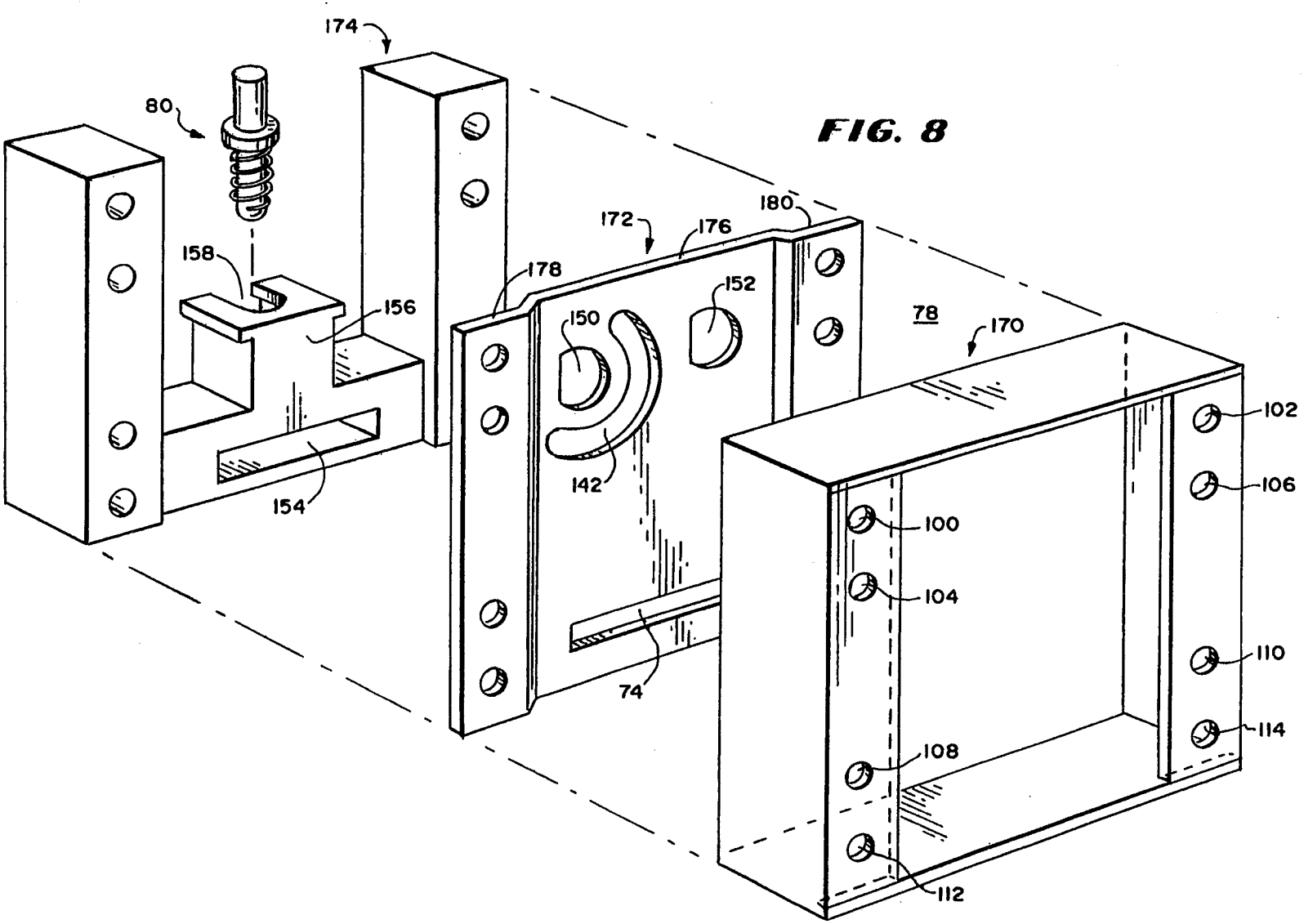
FIG. 8 is an exploded perspective front view of the behind-the-door portion of the lock of the embodiments of FIGS. 1–7.

In FIG. 8, there is shown a front perspective view of the cabinet 78 having an outer cabinet 170, an inner cabinet front plate 172, and an inner cabinet body 174. The inner cabinet front plate 172 has a recessed portion 176 centrally located and outer wing portions 178 and 180 sized to fit within the outer cabinet 170 with its bolt and assembly screw holes aligned with the bolt and assembly screw holes 100–114 of the outer cabinet 170 for mounting purposes.

In the inner panel front plate 172, the recessed portion 176 includes the cylinder openings 150 and 152 to receive the lock cylinders 134 and 132 (FIG. 5) and includes the slot 74 to receive the retainer 38B (FIG. 5). The inner cabinet body 174 includes wing portions having bolt and assembly screw holes adapted and aligned with the bolt holes of the winged portions 178 and 180 and a substantially open center portion with an upstanding boss 156. The boss 156 includes a slot 154 to receive the bottom of the retainer and a central opening 158 extending into and joining with the slot 154 so that the dead bolt 80 can be moved downwardly through the opening 158 into the slot 154 to engage the holes 58B in the bottom 56B of the retainer 38B (FIG. 5).

With this arrangement, the inner cabinet body 174, the front plate 172 and the outer cabinet 170 telescope within each other to form a compact unit adapted to be mounted in the inside of the door and hold the inner portion of the lock protected from the elements.

Figure 9:
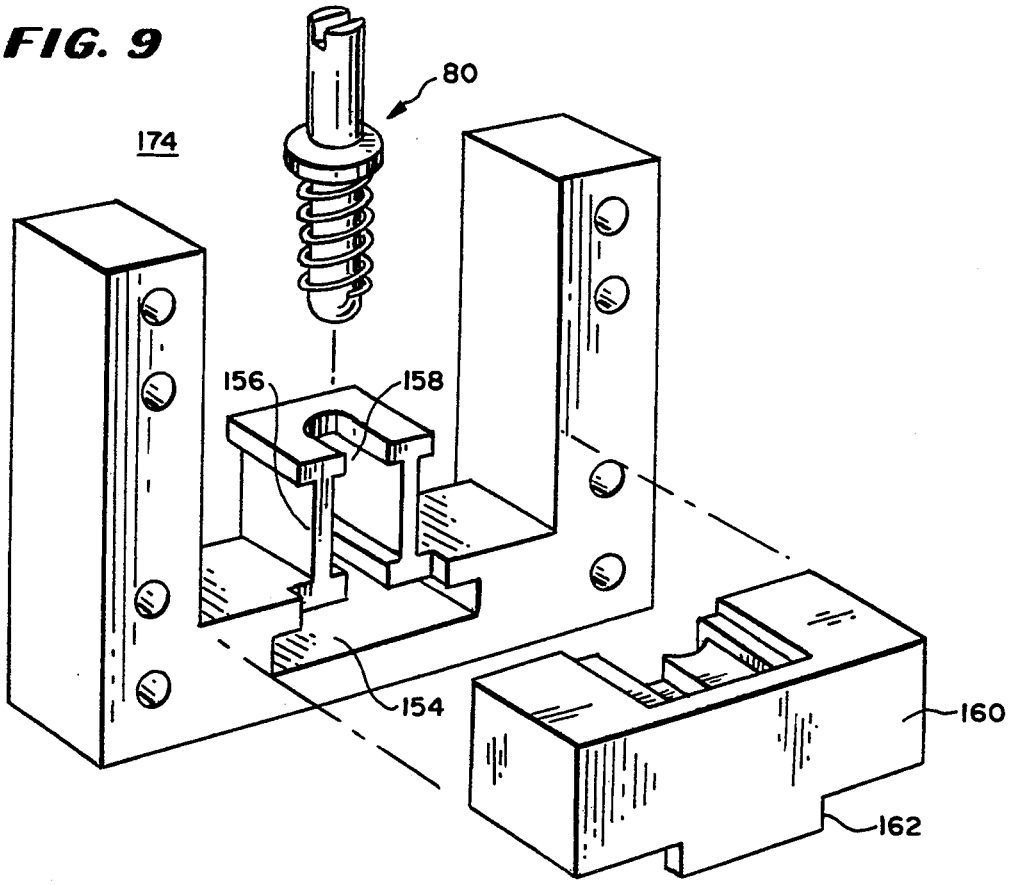
FIG. 9 is an exploded rear perspective view of the behind-the-door portion of the lock of FIGS. 1–8.

In FIG. 9, there is shown a rear exploded perspective view of the inner cabinet body 174 with the dead bolt 80 exploded away from the opening 158 above the slot 154. As shown in this view, an inter-locking cavity component 160 containing a downwardly extending slot 162 closes the opening.158 and the slot 154 so as to conveniently form a closed compartment which receives and stops the retainer bottom with the holes positioned to receive the dead bolt 80.

Figure 10:
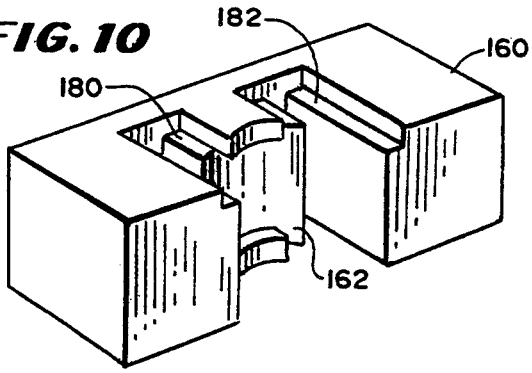
FIG. 10 is a perspective front view of a portion of the embodiment shown in FIG. 9.

As best shown in FIG. 10, the inter-locking cavity component 160 includes recessed ledges 180 and 182 adapted to receive the rectangular flanges on the boss 156 (FIG. 9) and the bottom striking plate or retaining plate 162 so as to fit within the inner compartment 174 (FIGS. 8 and 9) with its outer members being sized to abut the inner compartment, its bottom adapted to abut the bottom and its lateral ledges adapted to receive the flanges on the boss 156, thus forming a suitable compartment to receive the deadbolt 80.

Figure 11:
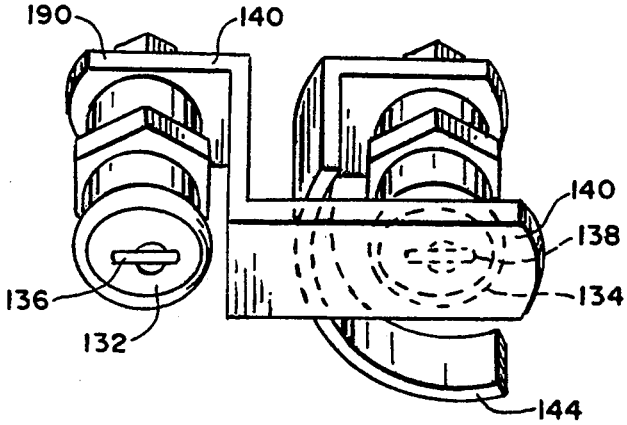
FIG. 11 is a perspective view of a portion of the locking mechanism of the embodiments of FIGS. 1–10.

In FIG. 11, there is shown a front perspective view of the first and second key cylinders 132 and 134 of the first and second locking means respectively having keyslots 136 and 138 with the lever arm 140 moved in position to block the keyslot 138 for the first cylinder 134 and the second lever arm 144 in locking position where it would, in a complete assembly, depress the dead bolt assembly 80 into the retainer ring (FIG. 6 and 7). As shown in this view, the first cam arm 140 is substantially Z-shaped and formed of a flat plate member, with an opening engaging a square shaft portion of the first key cylinder 134 so as to move the first cam 140 therewith.

Figure 12:
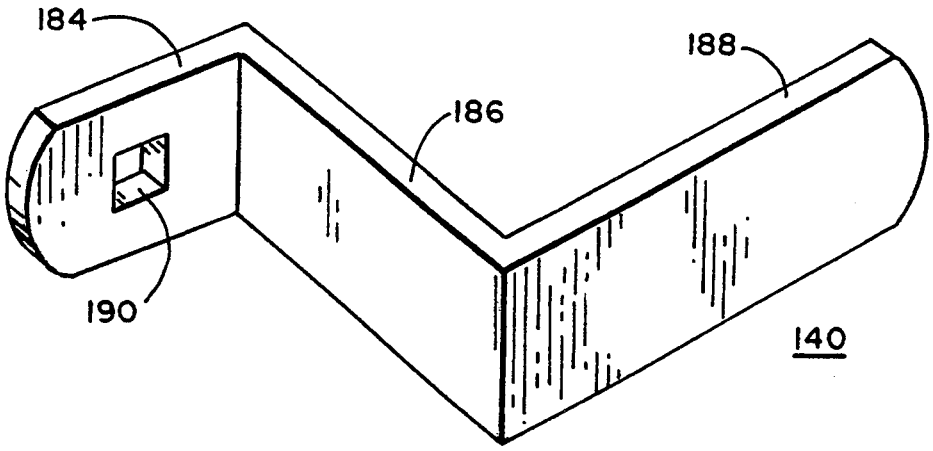
FIG. 12 is a perspective view of a lever in accordance with the embodiment of FIG. 11.

As best shown in the perspective view of FIG. 12, the first cam arm 140 includes a section 184 having a square opening 190, a section 186 which is a parallelopiped extending at right angles from the portion 184 a sufficient distance so that it extends in front of the key cylinder 134 (FIGS. 5 and 6) and which has the same thickness and width as the section 184 and a portion parallel to the portion 184 also shaped generally as a parallelopiped and sufficiently long to overlie the keyslot 138.

Figure 13:
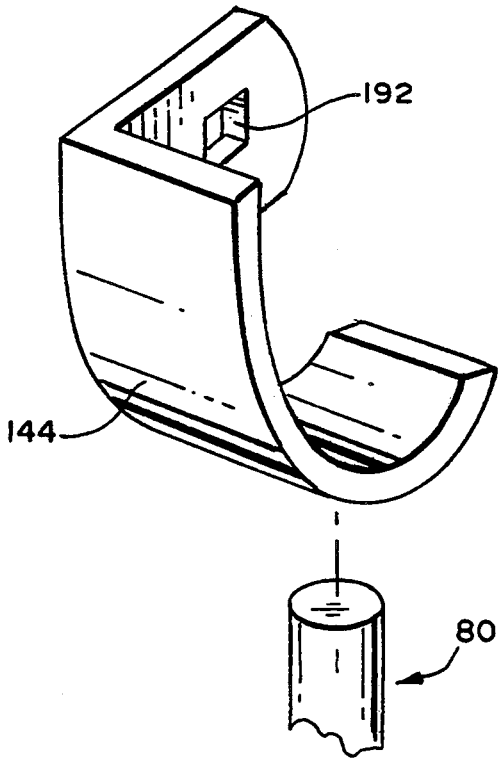
FIG. 13 is a perspective fragmentary view of a camming lever mounted in position with a dead bolt in accordance with the embodiment of FIG. 11.

As best shown in FIG. 13, the cam 144 includes a similar square opening 192 and a relatively broad curved section adapted to be moved downwardly and engage the top of the dead bolt 80 with a broad surface not requiring alignment when moved by the second lock cylinder 134.

Figure 14:
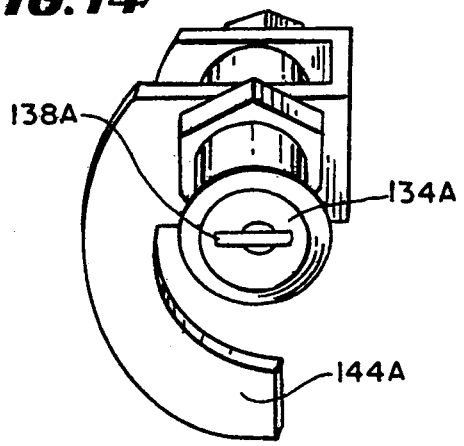
FIG. 14 is a perspective view of another embodiment of a lever arm and actuating mechanism of the lever arm different from that shown in the embodiment of FIGS. 11 and 13.
Figure 15:
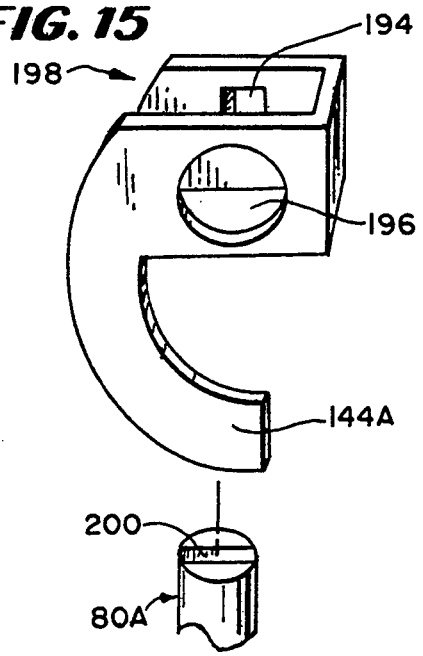
FIG. 15 is a perspective view of the lever arm of FIG. 14 shown mounted in perspective with another embodiment of dead bolt.

In FIGS. 14 and 15, there is shown another embodiment of second cam arm 144A also adapted to be moved into position but to cooperate with the deadbolt 80A having a slot 200 therein. This unit includes a U-shaped portion 198 having a circular opening 196 and a square opening 194 on opposite legs of the U, with a curved relatively narrow cam 144A extending downwardly and sized to engage a groove 200 in the top of the dead bolt 80A. As best shown in FIG. 14, the sides of the U portion both engage the cylinder 134A which permits proper alignment of the arm 144A shown in FIG. 15. This provides a firmer grip on the dead bolt 80A. Of course, instead of a cylindrical deadbolt engaging a hole in a retainer, any moving or loading member inside the door may be used to engage any opening inside the door in a unit that extends outside the door and engages the lever arm 32B.

Figure 16:
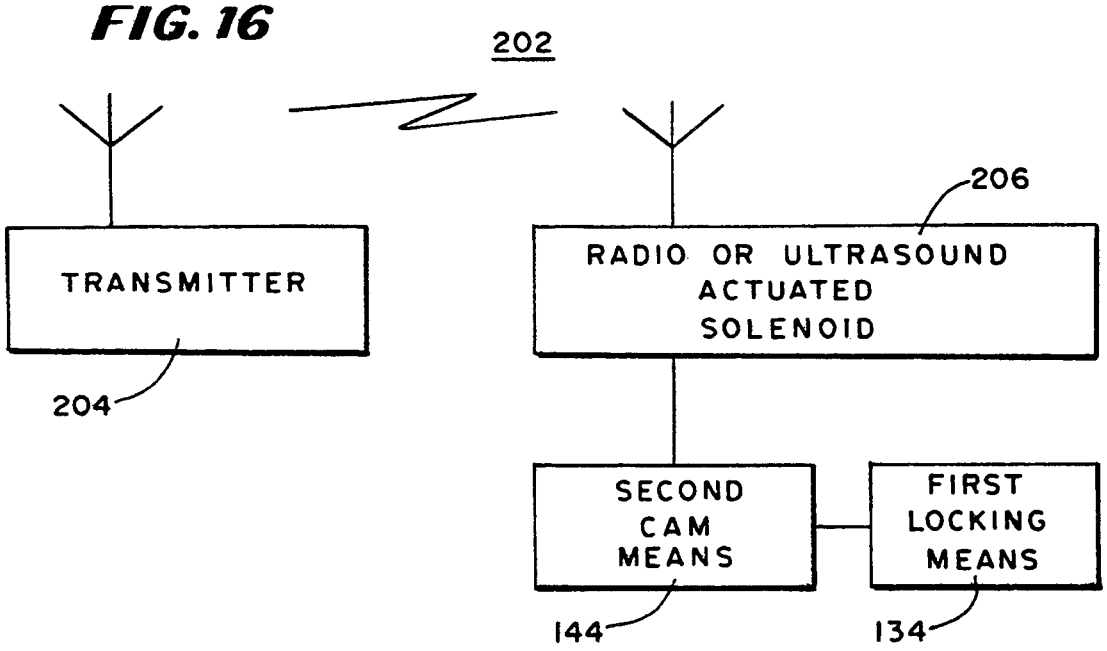
FIG. 16 is a block diagram of a modification of the embodiment of FIGS. 1–15.

In FIG. 16, there is shown a block diagram of another embodiment of actuator 202 adapted to cooperate with a transmitter 204 and a radio actuated solenoid or ultrasonic sound actuated solenoid 206 including a receiver and drive means for moving the second cam means 144 in position to block the first locking means 134. This radio actuated unit may be any radio actuated solenoid or motor driven screw drive such as disclosed in U.S. Pat. Nos. 3,725,939; 4,135,377 or 993,067 adapted to drive the dead bolt into place or to move a protecting plate of the keyhole of the first locking means. In the alternative, ultrasound may be transmitted and received in the manner of conventional tone generating devices. In use, a keylock may be used for one or both of the first and second actuators and the radio unit for the other if only one is radio operated thus permitting a truck operator to move one of the first and second cam means while a key is necessary for the other in proper sequence.

Figure 17:
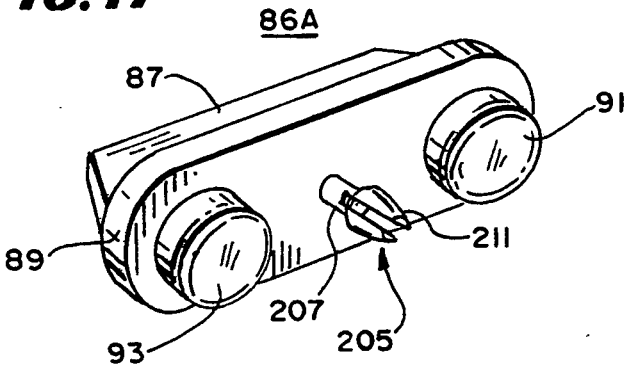
FIG. 17 is a perspective view of an alternative embodiment of the keyhole cover used in the embodiments of FIGS. 1–15.

In FIG. 17, there is shown another embodiment of keyhole cover 86A similar to the keyhole cover 86 shown in FIG. 5 and having corresponding parts indicated with the same reference numeral. However, in the embodiment 86A of FIG. 17, an anchor nipple 205 between plugs 93 and 91 is provided. The nipple is adapted to fit within opening 35B (FIGS. 2 and 4) between keyhole openings 36B and 34B (FIGS. 2 and 4) so that the keyhole cover can be pulled back and twisted to uncover the keyholes without removing it from the lock. To cover the keyholes, the cover 86A can be twisted to align the plugs 91 and 93 with the keyholes and pushed in place. A shaft 207 of the nipple 205 is sufficiently long to permit the plugs 91 and 93 to be removed and the cover 86A to be turned while a head 211 of the anchor nipple 205 is still in the opening 35B.

From the above description, it can be understood that the lock of this invention has several advantages, such as for example: (1) it reduces the ability of an unauthorized person to actuate the lock and open the door; (2) it can be adapted to require the cooperation of two persons to permit unlocking of a door; and (3) it provides a positive guard against cutting free a portion of a locking mechanism.

Although a preferred embodiment of the invention has been described with some particularity, many modifications and variations in the invention are possible within the light of the above teachings. Therefore, it is to be understood, that within the scope of the appended claims the invention may be practiced other than as specifically described.

What is claimed is:

1. A van safety rod lock comprising:

first and second lock bars movably mounted to first and second van doors on a first side of the first and second van doors;

first, second, third and fourth keepers;

the first keeper mounted to the frame of the van above said first door in position to engage a first end of a first rod and the second keeper being mounted to the frame of the van below said first door and adapted to engage a second end of said first rod whereby said first rod extends releasably between said first keeper and second keeper across said door where it may engage said keepers to hold the door in place or be disengaged from said keepers so as to move with said door as it opens;

said third keeper being mounted to the frame of said van above said second door where it may engage a first end of said second bar;

said fourth keeper being mounted to the frame of said van below said second door where it may engage a second end of said second bar, wherein said second bar is movably mounted to said door between said third keeper and fourth keeper to lock said second door closed or move it to an open position with said second door when released from said third and fourth keepers;

a first lever means mounted to said first bar for movement therewith wherein said first lever means when mounted substantially parallel to said first door moves said first bar into engagement with said first and second keepers and when moved to an angular position with respect to said first door disengages said first bar from said first and second keepers;

a second lever means fastened to said second bar for movement therewith, wherein when said second bar is substantially parallel to said second door said second bar has its ends engaged with said third and fourth keepers and when rotated to an angle, with respect to said second door, has said ends of said second bar released from said third and fourth keepers;

retainer means for engaging at least one of said first lever means and second lever means and locking it in a position substantially, parallel to said first door;

said first retainer means including apertured means extending through said first door;

first locking means adapted to be actuated from outside said van adapted to move a dead bolt into an aperture of said apertured means whereby said first retainer means is locked in position from within the van or to move the dead bolt from the aperture;

said first locking means including actuating means by which said first locking means may be actuated from outside said van; and second locking means adapted to be actuated from outside said van to block said second actuating means from said first locking means whereby said actuating means may be locked in place to prevent movement of said dead bolt.

2. A van safety rod lock according to claim 1 in which said means for actuating said first locking means is a key.

3. A van safety rod lock according to claim 1 in which said second locking means includes a radio-operated solenoid.

4. A method of preventing the unlocking of a door on a van by unauthorized persons comprising the steps of:

placing a retainer clamp around a handle of said door which handle is outside the van with a portion of the retainer clamp extending through the door;

actuating from outside the van a locking means within the van to engage the portion of the retainer clamp and to hold the retainer clamp in place;

blocking the locking means from outside the van with a blocking means inside the van to block access to the locking means from outside the van, wherein unlock the door, the blocking means must be activated before the locking means for the retainer clamp can be unlocked;

the step of placing a retaining clamp around said handle including the step of placing an apertured clip having one side extending through a slot in the door and the step of actuating the locking means includes the step of moving a dead bolt into an aperture of the apertured clip; and unblocking access to the locking means by removing a shield from between the locking means and locations outside the van adjacent to the door.

* * * * *